US005722438A

United States Patent [19]

Gors

[11] Patent Number: 5,722,438

[45] Date of Patent: Mar. 3, 1998

[54] CIGAR-CIGARETTE ASHTRAY AND CIGAR-CIGARETTE HOLDING STRUCTURE

[76] Inventor: Don Gors, 6015 N. Ridge Ave., Chicago, Ill. 60660-2328

[21] Appl. No.: 602,120

[22] Filed: Feb. 15, 1996

[51] Int. Cl.[6] ..... A24F 19/00

[52] U.S. Cl. ..... 131/231; 131/240.1; 131/241; D27/102

[58] Field of Search ..... 131/256, 231, 131/240.1, 241, 206; D27/102

[56] References Cited

U.S. PATENT DOCUMENTS

| | | | |
|---|---|---|---|
| D. 104,168 | 4/1937 | Mackelfresh | 131/231 |
| D. 107,873 | 1/1938 | Kelly | 131/231 |
| D. 125,915 | 3/1941 | Heilbron | 131/231 |
| D. 142,130 | 8/1945 | Swofford | 131/231 |
| D. 162,130 | 2/1951 | Cross | 131/231 |
| D. 168,296 | 3/1952 | Gamby | 131/231 |
| D. 175,648 | 9/1955 | Ross et al. | D27/102 |
| D. 196,351 | 9/1963 | Anholt | 131/231 |
| D. 279,721 | 7/1985 | Martinovics | 131/231 |
| 2,063,717 | 9/1936 | Barbiere | 13/240.1 |
| 2,352,756 | 7/1944 | Anholt | 131/231 |
| 2,425,428 | 8/1947 | Graffenberger | 131/231 |
| 2,463,485 | 3/1949 | George | 131/231 |
| 2,683,460 | 7/1954 | Rice | 131/231 |
| 2,781,651 | 2/1957 | Cutler | 131/240.1 |
| 3,683,938 | 8/1972 | Rowland | 131/231 |
| 4,239,049 | 12/1980 | Perry | 131/235 |
| 4,579,129 | 4/1986 | Gillies | 131/231 |

FOREIGN PATENT DOCUMENTS

| | | | |
|---|---|---|---|
| 801302 | 8/1936 | France | 131/231 |

*Primary Examiner*—Vincent Millin
*Attorney, Agent, or Firm*—Banner & Witcoff, Ltd.

[57] ABSTRACT

An improved cigar and cigarette ashtray for receiving and retaining at least one lighted elongated smoking article as it burns down is disclosed. The ashtray includes a mechanism for holding lighted smoking articles, said holding mechanism adapted to receive and retain said lighted smoking articles. The mechanism for holding is configured to support a substantial portion of the unburned longitudinal length of said at least one lighted smoking article in a substantially horizontal position. The mechanism for holding lighted smoking articles also includes a plurality of smoking-article-holding grooves. An ashtray insert is also disclosed. The ashtray insert is utilized in conjunction with an existing ashtray and is adapted to receive and retain at least one lighted smoking article.

5 Claims, 10 Drawing Sheets

CIGAR-CIGARETTE ASHTRAY AND CIGAR-CIGARETTE HOLDING STRUCTURE

FIELD OF THE INVENTION

The present invention relates to an improved cigar and cigarette ashtray. More particularly, the present invention relates to ashtrays of the type having a plurality of rests upon which burning cigars or cigarettes (hereinafter collectively referred to as a "smoking articles") may be placed when not in use. In addition, the present invention relates to improved cigar and cigarette holding structures for existing cigar-cigarette ashtrays.

BACKGROUND OF THE INVENTION

Prior to the development of the present invention, when a cigar was placed in an ordinary ashtray, it was not uncommon for a number of problems to occur. For example, smoking articles frequently become dislodged and fall forward into the bottom of ashtrays. This either causes the end of a smoking article which had been in the user's mouth to become soiled and unfit for further use, or causes lit portion of a smoking article to come into contact with the bottom of an ashtray. If the lit portion of a smoking article comes into contact with a cool smooth-surfaced ashtray bottom, heat produced by the lit end of the smoking article causes condensation to form. This not only causes the lit end of the smoking article to burn unevenly but also causes the lit end of the smoking article to become damp.

In order to prevent cigars from becoming displaced, users typically attempt to force cigars into some sort of groove which is typically designed for cigarette use. However, by placing a cigar into such a groove, the outer leaves of the cigar become damaged by cracking or tearing, since cigars often do not fit into such grooves because of larger ring gauges. Thus, the damaged cigar results in noticeable problems relating to a users "draw" on the cigar.

Various types ashtrays for smoking articles were known in the prior art. In general, prior art ashtrays comprise a receptacle or bowl for ashes surrounded by a raised rim upon which a lighted cigar may rest. In most designs, the cigar rests on the raised rim with its burning tip pointed towards the center of the receptacle at approximately a 30° angle from the horizontal plane formed by the outer rim of the ashtray. Alternatively, the cigar is lodged in a channel or groove which is formed in the rim of the ashtray which is designed to stop the cigar from slipping or rolling sideways. However, with both of these designs, a neglected cigar will frequently fall forward until its burning tip is resting in the ash receptacle. In addition, it is common for a neglected cigar to become unbalanced as the cigar burns down, thereby falling onto a counter or table-top. The former tends to cause condensation to form as well as cause the cigar to burn unevenly, whereas the latter can constitute a significant fire hazard.

A typical example of an ashtray is identified in U.S. Pat. No. 2,352,756, which was filed by H. Anholt on Mar. 24, 1941. This patent discloses an ashtray that includes a bowl-like receptacle with an upstanding wall terminating at its top in a peripheral cigar-support. This ashtray also includes a partition member extending across its receptacle bottom and dividing its interior into two segmental compartments of substantially uniform size. The partition member includes end portions, the top portions of which are at a distance below the elevation of the rim and have an intermediate portion, the top surface of which is arcuate and serrated, with the highest points of the serrations at approximately the elevation of the rim. The serrations define rests on the partition and are disposed transversely to its lengthwise axis. The distance from the rests to any point on the rim to which a smoking article seated in a rest may extend is in excess of one-half the length of a standard-sized smoking article.

Another example of an ashtray incorporating a cigar rest is identified in U.S. Pat. No. 4,579,129, which issued to D. Gillies on Apr. 1, 1986. This patent discloses a cigar rest for an ashtray with a bowl for cigar ashes. The rest includes a first and second support for supporting forward and rearward ends of a cigar. With this cigar rest, each support is capable of supporting no more than a short length of a cigar and the support surface of the second support is positioned at a level below that of the support surface of the first support. On the other side of the second support, a lip is disposed which limits the rearward axial movement of a cigar resting on the supports. The first support surface is located at a distance from the lip equal to at least half the length of the cigar and the second support surface is positioned nearer to the lip than the first support. The rest is constructed and arranged so that the tip of a cigar resting thereon will project over the bowl of the ashtray.

While the above mentioned devices are marginally effective for their intended usage, none of these devices are capable of optimally supporting the continuously decreasing length of a lighted or burning smoking article. In other words, the prior art ashtrays are only capable of supporting a limited portion of the unburned longitudinal length of a lighted smoking article. Moreover, the ashtrays do not accommodate for the changes in length of a smoking article as it burns down. In addition, the prior art ashtrays are incapable of balancing a lighted smoking article which has a continuously decreasing length in a substantially horizontal position. Furthermore, none of the prior art ashtrays allow a user to continuously roll a lighted smoking article in a smoking-article-holding groove in order to maintain a radially even burn.

Thus, one of the objects of the present invention is to provide an improved ashtray capable of supporting a substantial portion of the unburned longitudinal length of a lighted smoking article regardless the lighted smoking article's continuously decreasing length.

Another object of the present invention is to provide an improved ashtray capable of supporting a lighted smoking article in a substantially horizontal position.

A further object of the present invention is to provide an improved ashtray capable of holding a lighted smoking article in a smoking-article-holding groove such that a user is able to roll the lighted smoking article in order to maintain a radially even burn.

Still a further object of the present invention is to provide an improved ashtray capable of preventing a lighted smoking article from becoming dislodged and tipping onto a countertop.

Yet another object of the present invention is to provide an ashtray capable of preventing a lighted smoking article from becoming dislodged and tipping into the bottom of an ashtray.

Still another object of the present invention is to provide a smoking-article-holding structure insert for use with existing prior art ashtrays such that a combination of a prior art ashtray and the structure is capable of accomplishing one or more of the foregoing objects of the present invention.

Another object of the present invention is to provide an ashtray that will accommodate a smoking article of any size ring gauge and length.

It is thus apparent that there is not only a need for an improved cigar-cigar ashtray but also for a smoking-article-holding structure insert for use with existing prior art ashtrays.

SUMMARY OF THE INVENTION

In view of the foregoing disadvantages inherent in the known types of cigar and cigarette ashtrays present in the prior art, it is therefore an object of the present invention to overcome the aforementioned disadvantages of heretofore known ashtrays and to provide an improved ashtray for receiving and retaining at least one lighted smoking article as well as the remains of each lighted smoking article.

These and other objects of the present invention are achieved an ashtray for receiving and retaining at least one lighted smoking article as it burns down. The ashtray includes a mechanism for holding said at least one lighted smoking article, said holding mechanism adapted to receive and retain said at least one lighted smoking article. The mechanism for holding is configured to support a substantial portion of the unburned longitudinal length of said at least one lighted smoking article and to prevent said at least one lighted smoking article from tipping.

In one embodiment of the present invention, the mechanism for holding said at least one lighted smoking article supports said at least one lighted smoking article in a substantially horizontal position.

In another embodiment of the present invention, the mechanism for holding said at least one lighted smoking article also includes a plurality of smoking-article-holding grooves.

In a further embodiment of the present invention, the mechanism for holding said at least one lighted smoking article also includes at least four smoking-article-holding grooves with each groove having a different length.

In further preferred embodiments of the present invention, the following features may also be included. The perimeter of the ashtray may be constructed in the shape of a polygon or may be curvilinear. In addition, the smoking-article-holding grooves may either be arc-shaped or v-shaped.

The foregoing objects are also achieved in an ashtray insert for receiving and retaining at least one lighted smoking article which is utilized in conjunction with an existing ashtray. The ashtray insert includes a mechanism for holding said at least one lighted smoking article. The holding mechanism is adapted to receive and retain said at least one lighted smoking article. The holding mechanism is configured to support and to prevent said at least one lighted smoking article from tipping. The ashtray insert is coupled to the existing ashtray.

In another embodiment of an ashtray insert constructed according to the present invention, the mechanism for said at least one lighted smoking article supports said at least one lighted smoking article in a substantially horizontal position.

In a further embodiment of an ashtray insert constructed according to the present invention, the mechanism for holding said at least one lighted smoking article also includes a plurality of smoking-article-holding grooves.

In still a further embodiment of an ashtray insert constructed according to the present invention, the mechanism for holding said at least one lighted smoking article also includes at least four smoking-article-holding grooves, with each groove having a different length.

The foregoing objects of the present invention are also achieved in an ashtray for receiving and retaining an elongated lighted smoking article as it burns down. The ashtray includes at least one ashtray wall having an upper portion with a plurality of smoking-article-holding grooves of decreasing length disposed substantially horizontally on the upper portion, whereby each successive smoking-article-holding groove will support a substantial portion of the unburned longitudinal length of said at least one smoking article and to prevent said smoking article. The ashtray also includes at least one ashtray receptacle for receiving and retaining the burned remains of each lighted smoking article, said at least one ashtray receptacle operatively coupled to said at least one ashtray wall.

The foregoing objects are also achieved in an ashtray for receiving and retaining an elongated lighted smoking article as it burns down. The ashtray includes at least one ashtray receptacle for receiving and retaining the burned remains of each lighted smoking article. At least one ashtray wall is coupled to said at least one ashtray receptacle. The ashtray also includes a smoking-article-holding structure coupled to each ashtray receptacle and to each ashtray wall, said smoking-article-holding structure having a top surface a plurality of smoking-article-holding grooves disposed substantially horizontally on the top surface, whereby each successive smoking-article-holding groove will support a substantial portion of the unburned longitudinal length of said smoking article.

These and other novel advantages, details, embodiments, features and objects of the present invention will be apparent to those skilled in the art from the following detailed description of the invention, the attached claims and accompanying drawings, listed hereinbelow, which are useful in explaining the invention.

BRIEF DESCRIPTION OF THE DRAWINGS

In the text which follows and in the drawings, wherein similar reference numerals denote similar elements throughout the several views thereof, the present invention is explained with reference to illustrative embodiments, in which.

DETAILED DESCRIPTION OF THE INVENTION

Figure 1:
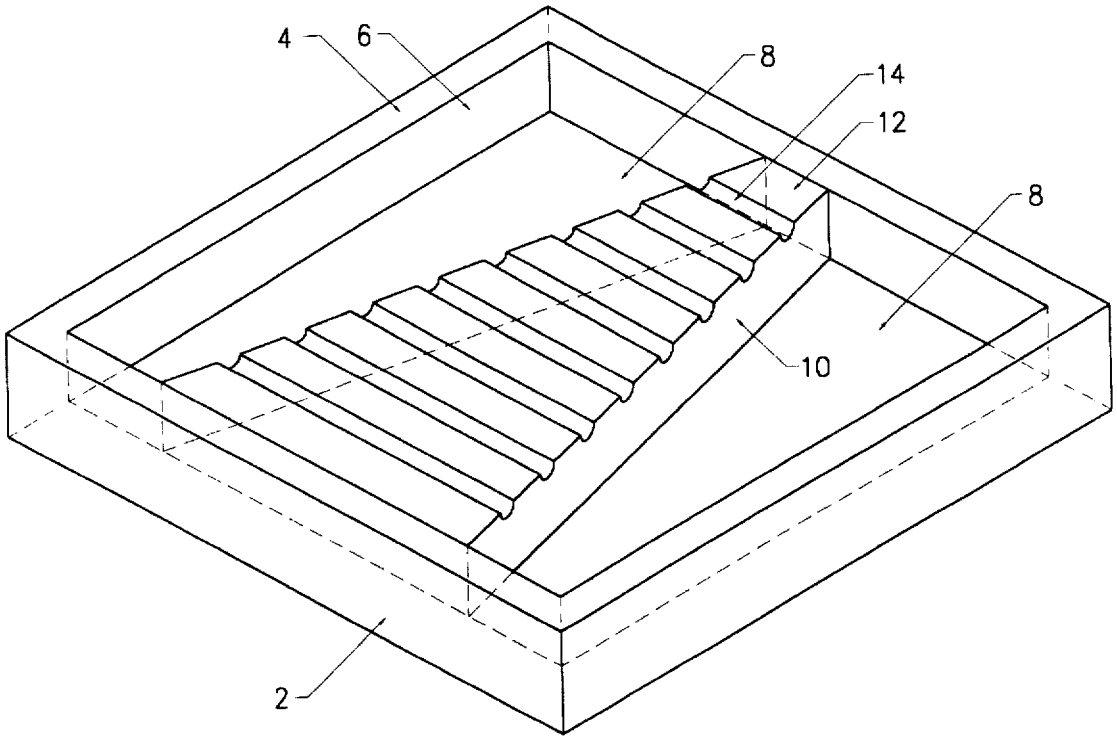
FIG. 1 is an orthographic projection of a rectangular ashtray constructed in accordance with the present invention.

For a better understanding of the present invention, reference may be had to the following detailed description taken in conjunction with the accompanying drawings. Each reference numeral is consistent throughout all of the drawings.

FIG. 1 depicts an orthographic projection of a rectangular ashtray constructed in accordance with the present invention. The ashtray comprises a body with a perimeter wall that has an outer surface (2), an upper portion (4), an inner surface (6), and a bottom (8) which forms one or more ashtray receptacles (8). Each ashtray receptacle (8) abuts at least one side wall (10) of a smoking-article-holding structure. Thus, the inner surface (6) of the perimeter wall, the ashtray receptacle(s) (8), and the side wall(s) (10), collectively function so as to prevent ashes from smoking-articles from spilling or becoming dislocated.

The smoking-article-holding structure is also attached to one or more inner surfaces (6) of the perimeter wall. In addition to the side wall(s) (10), the smoking-article-holding structure also includes a top surface (12). A plurality of smoking-article-holding grooves (14) are located on the top surface (12). The smoking-article-holding grooves (14) can be arc-shaped, v-shaped, or in any other type of configuration suitable for holding lighted smoking articles. In this arrangement, the length of each groove is varied in order to accommodate the continuously decreasing length of a lighted smoking article, thereby supporting a substantial portion of the unburned longitudinal length of the lighted smoking article. When used in this context, "a substantial portion" means that the support spans at least one-third of the unburned longitudinal length of the lighted smoking article.

Figure 8:
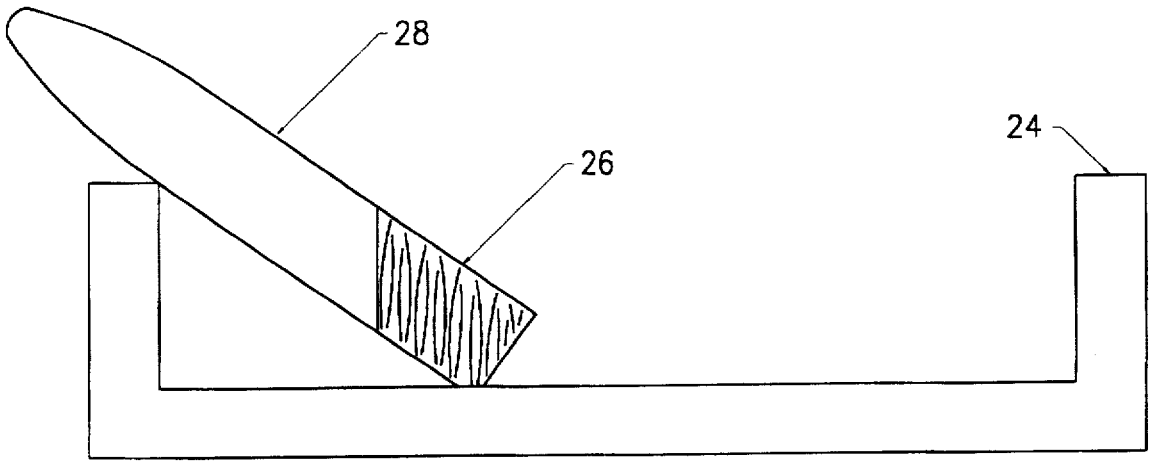
FIG. 8 is cross-sectional view of a prior art ashtray.
Figure 9:
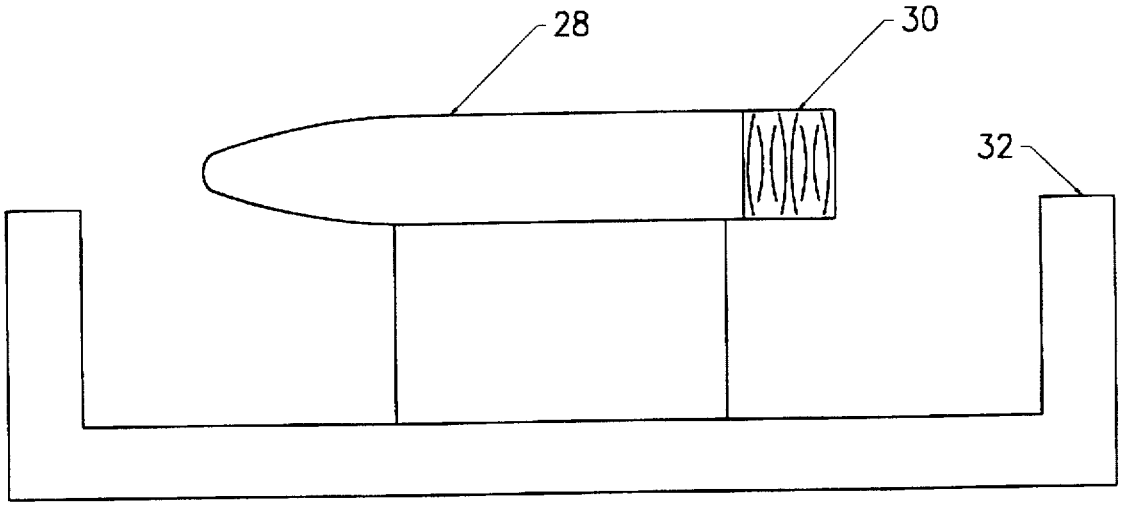
FIG. 9 is a cross-sectional view of a ashtray constructed in accordance with the present invention.
Figure 10:
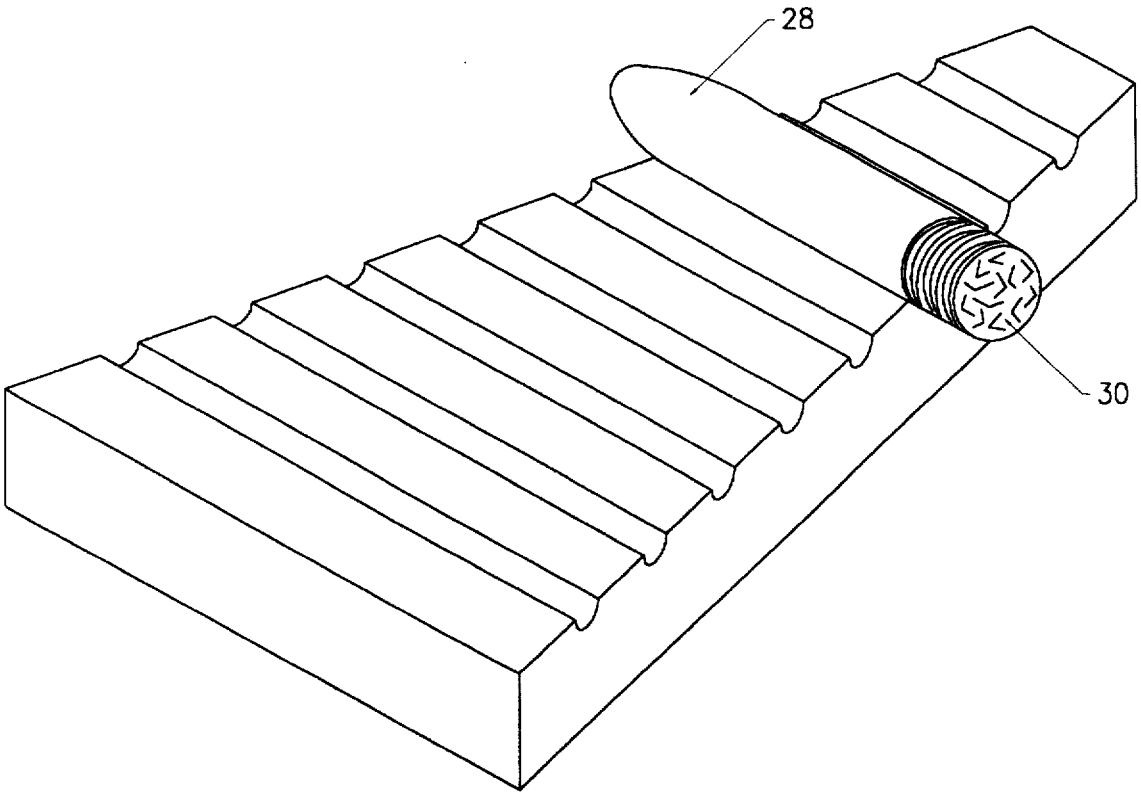
FIG. 10 is a orthographic projection of an insert holding a lighted smoking article.

In this configuration, lighted smoking articles are placed in the smoking-article-holding grooves (14). The grooves (14) support each lighted smoking article in a substantially horizontal position and prevent the lighted smoking articles from tipping onto a countertop or into the ashtray receptacle (8). As the length of each smoking article decreases as the smoking article burns, the smoking articles can be manually relocated to a smoking-article-holding groove (14) which corresponds to the current length of the smoking article, thereby ensuring that the ashtray continues to support a substantial portion of the unburned longitudinal length of the lighted smoking article. Furthermore, this configuration enables a user to roll or rotate a lighted smoking article within any given smoking-article-holding groove (14). Rolling or rotating a lighted smoking article within a smoking-article-holding groove ensures that the lighted smoking article maintains a radially even burn. A lighted smoking article with a radially even burn is depicted in FIGS. 9 and 10, whereas a prior art ashtray with a lighted smoking article that has an uneven burn is shown in FIG. 8. In this embodiment, each outer surface (2) is approximately nine to twelve inches in length, and each smoking-article-holding groove (14) will accommodate a smoking-article with a diameter of approximately twenty-five to fifty-two ring gauge.

Figure 2:
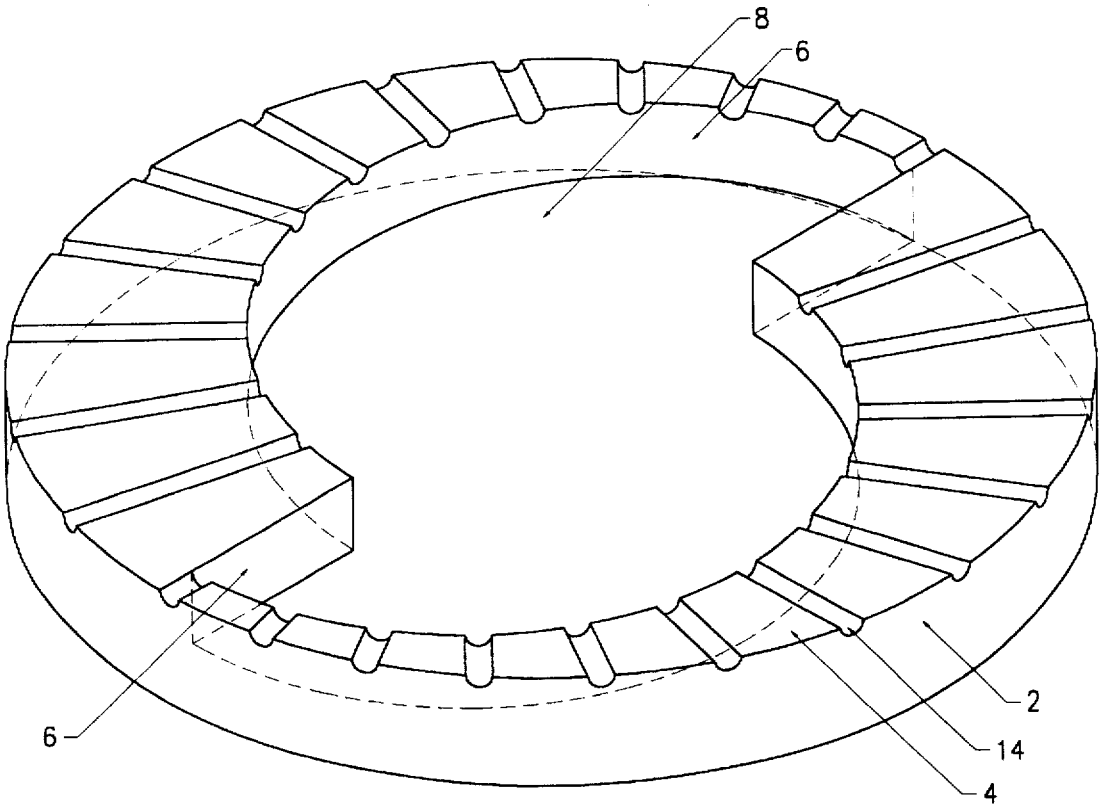
FIG. 2 is an orthographic projection of an ashtray with a circular perimeter constructed in accordance with the present invention in which smoking-article-holding grooves are disposed on the upper portion of the perimeter wall.

FIG. 2 depicts an orthographic projection of an ashtray with a circular perimeter constructed in accordance with the present invention in which smoking-article-holding grooves (14) are disposed on the upper portion (4) of the perimeter wall. In this configuration, the smoking-article-holding structure is the perimeter wall itself. Therefore, only one central ashtray receptacle (8) is utilized.

In the design illustrated in FIG. 2, the width of the perimeter wall is varied or shaped irregularly. Thus, the smoking-article-holding grooves have varying lengths. Therefore, this arrangement also accommodates the continuously decreasing length of a lighted smoking article by supporting a substantial portion of the unburned longitudinal length of the lighted smoking article in a substantially horizontal position. In this embodiment, the outer diameter of the ashtray is approximately nine to twelve inches, and each smoking-article-holding groove (14) will accommodate a smoking-article with a diameter of approximately twenty-five to fifty-two ring gauge.

Figure 3:
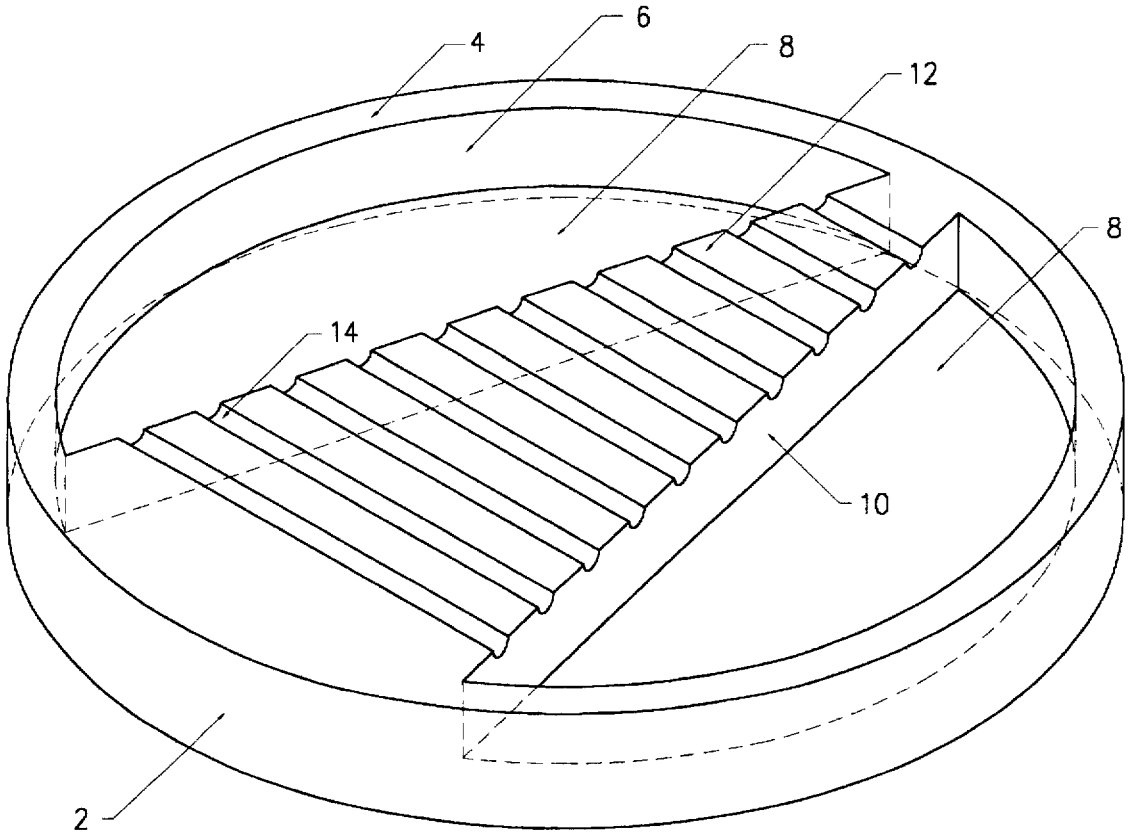
FIG. 3 is an orthographic projection of an ashtray with a circular perimeter constructed in accordance with the present invention in which smoking-article-holding grooves are disposed on a smoking-article-holding structure within the perimeter wall.

The embodiment depicted in FIG. 3 is an orthographic projection of an ashtray with a circular perimeter substantially similar to the embodiment depicted in FIG. 1. The only difference between the two embodiments is the shape of the perimeter wall. FIG. 3 shows an ashtray with a circular perimeter wall, whereas FIG. 1 illustrates an ashtray with a rectangular perimeter wall. In this embodiment, the outer diameter of the ashtray is approximately nine to twelve inches, and each smoking-article-holding groove (14) will accommodate a smoking-article with a diameter of approximately twenty-five to fifty-two ring gauge.

Figure 4:
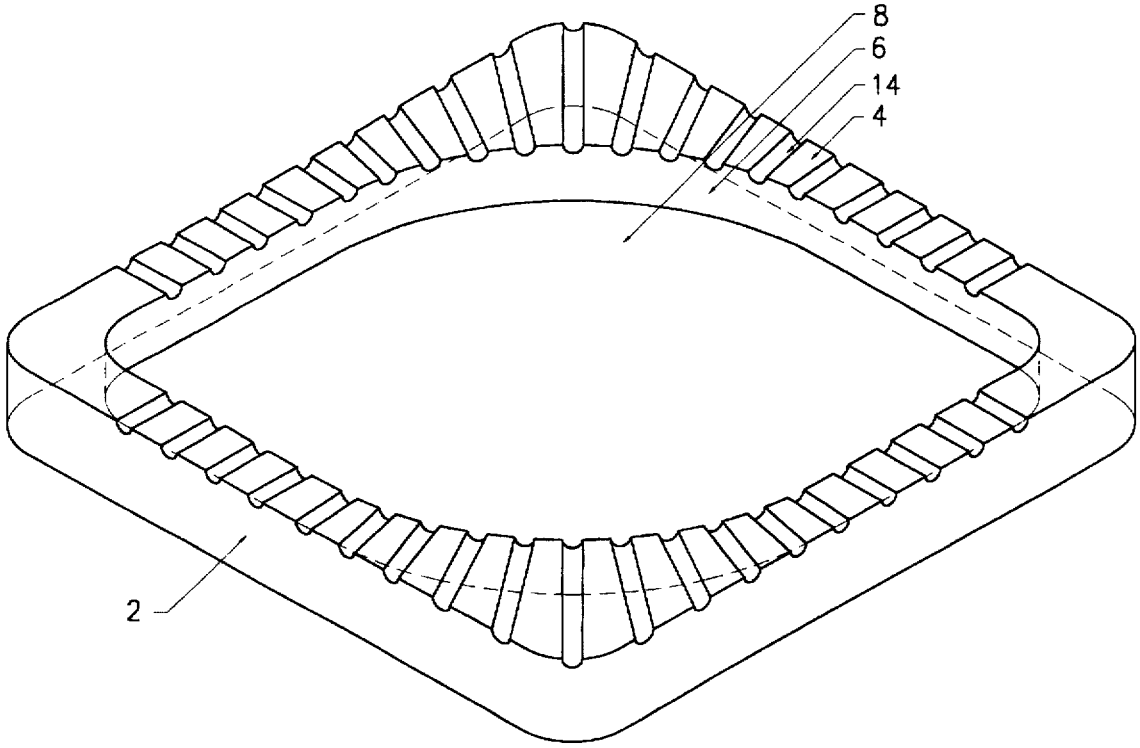
FIG. 4 is an orthographic projection of an ashtray with a rectangular perimeter and an elliptical ashtray receptacle.

FIG. 4 illustrates an orthographic projection of an ashtray with a rectangular perimeter and an elliptical ashtray receptacle. In this configuration, the smoking-article-holding grooves (14) are disposed on the upper portion (4) of the perimeter wall. In this embodiment, the smoking-article-holding structure is the perimeter wall itself. Therefore, this embodiment is similar to the ashtray depicted in FIG. 2, in that only one central ashtray receptacle (8) is utilized. In this embodiment, each outer surface (2) is approximately nine to twelve inches in length, and each smoking-article-holding groove (14) will accommodate a smoking-article with a diameter of approximately twenty-five to fifty-two ring gauge.

Figure 5:
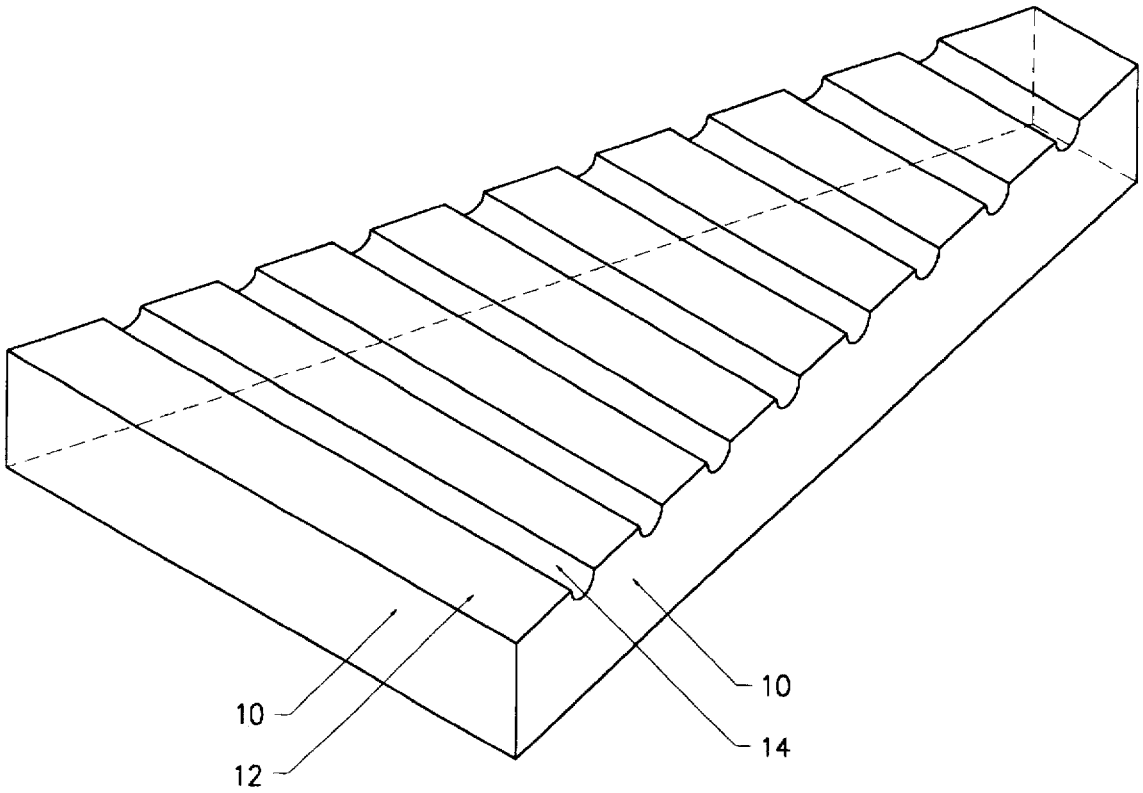
FIG. 5 is an orthographic view of an insert embodying features of the present invention.

FIG. 5 shows an orthographic projection of an insert embodying features of the present invention. The insert is substantially similar to the smoking-article-holding structures depicted FIGS. 1 and 3. The insert has side walls (10) as well as a top surface (12). A plurality of smoking-article-holding grooves (14) are located on the top surface (12). The smoking-article-holding grooves (14) can be concave, v-shaped, or in any other type of configuration suitable for holding lighted smoking articles. In this arrangement, the length of each groove is varied in order to accommodate the continuously decreasing length of a lighted smoking article by supporting a substantial portion of the unburned longitudinal length of the lighted smoking article in a substantially horizontal position. In this embodiment, each smoking-article-holding groove (14) will accommodate a smoking-article with a diameter of approximately twenty-five to fifty-two ring gauge. The remaining dimensions of the insert will vary depending on the size of the ashtray into which the insert is to be inserted.

Figure 6:
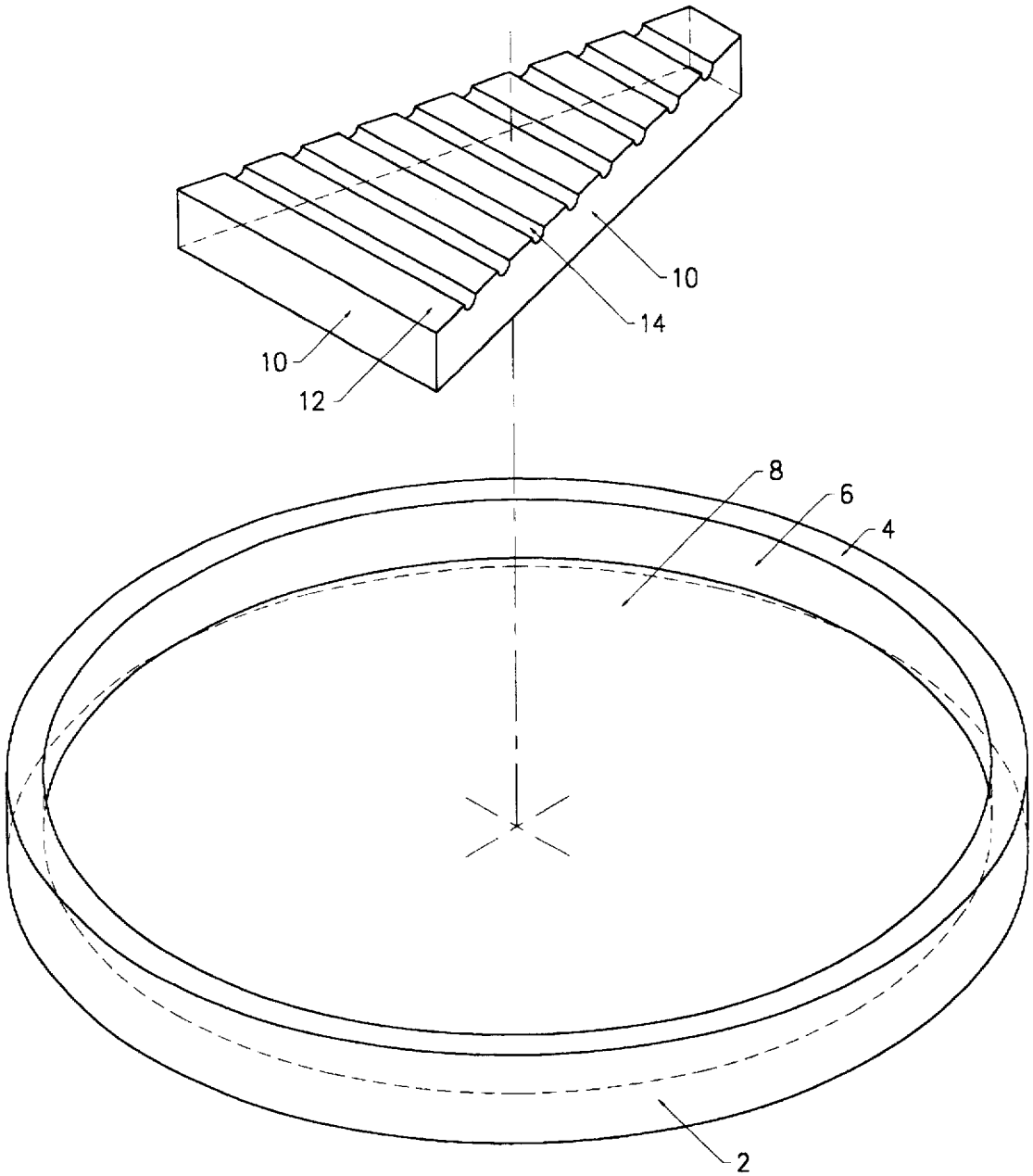
FIG. 6 is a an exploded view of an insert utilized in conjunction with an existing ashtray.

The insert depicted in FIG. 5 is useful when utilized in conjunction with an existing ashtray. FIG. 6 shows an exploded view of a typical configuration of such an insert; however, actual sizes and shapes will vary. An existing ashtray will typically have a side wall with an inner portion (20), an outer portion (16), and a top (18). Existing ashtrays also use an ashtray well (22) to collect fallen ashes. Thus, in this embodiment, an insert is coupled to the center of the well (22) of an existing ashtray. The insert can be coupled to the existing ashtray by utilizing any type of adhesive compound. Alternatively, the insert can simply be physically positioned within the ashtray well (22). In this arrangement, gravity keeps the insert positioned within the ashtray well (22).

Figure 7:
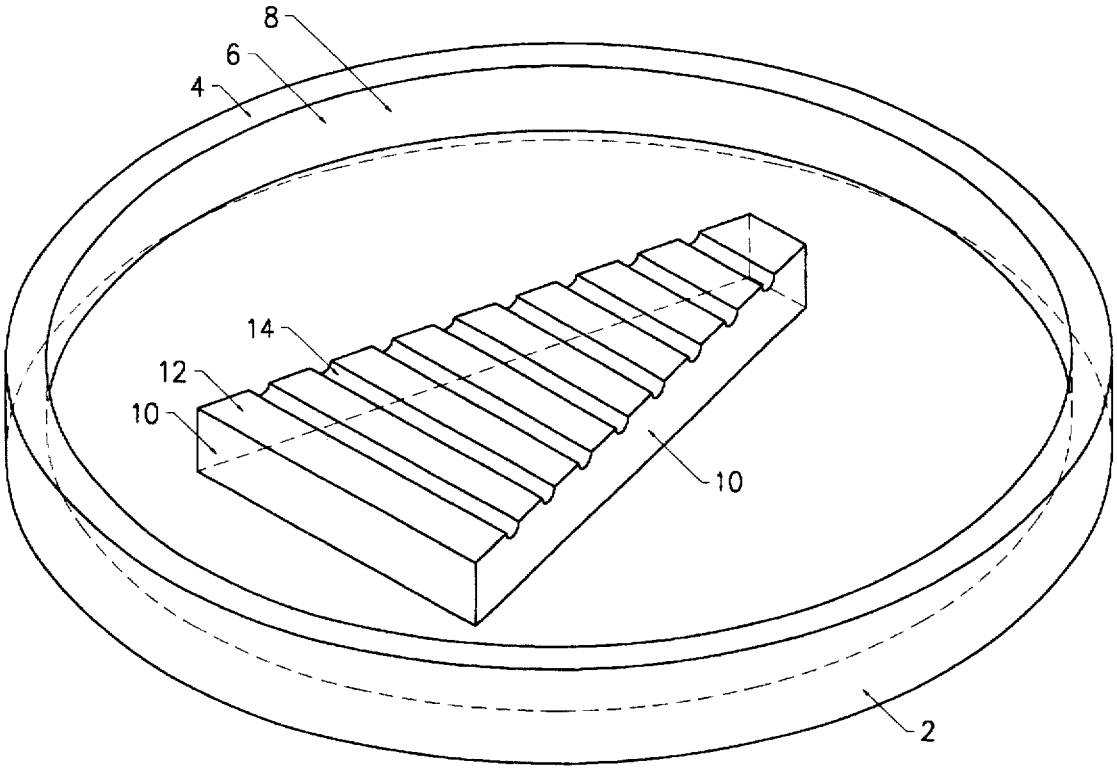
FIG. 7 is an orthographic projection of an insert utilized in conjunction with an existing ashtray.

FIG. 7 shows an orthographic projection of an insert utilized in conjunction with an existing ashtray as described in the foregoing paragraph. The embodiments depicted in FIGS. 6 and 7 enable a user to obtain the benefits of the present invention without having to discard the user's existing ashtrays.

FIG. 8 depicts a cross-sectional view of a prior art ashtray (24). FIG. 8 illustrates the typical uneven burn (26) on a lighted smoking article (28) acquired by utilizing a prior art ashtray (24). For clarity purposes, the uneven burn (26) portion of the lighted smoking article (28) is shaded in this illustration. An uneven burn causes the lighted smoking article to be consumed a significantly higher rate. Thus, the uneven burn caused by utilizing prior art ashtrays should be avoided and is avoided by the present invention.

FIG. 9 shows a cross-sectional view of a ashtray constructed in accordance with the present invention. FIG. 9 illustrates an example of a radially even burn. For clarity purposes, the radially even burn (30) portion of the lighted smoking article (28) is shaded in this figure. As is easily seen from this picture, a typical ashtray constructed in accordance with this invention (32) avoids uneven burns caused by prior art ashtrays.

FIG. 10 shows a orthographic projection of an insert holding a lighted smoking article (28). FIG. 10 is substantially similar to FIG. 9 in that both figures depict an ashtray or smoking-article-holding structure that supports a substantial portion of the unburned longitudinal length of a lighted smoking article (28) in a substantially horizontal position, thereby enabling a user to roll or rotate the lighted smoking article (28) in order to obtain a radially even burn (30).

In the foregoing specification, the present invention has been described with reference to specific exemplary embodiments thereof. It will be apparent to those skilled in the art, that a person understanding this invention may conceive of changes or other embodiments or variations, which utilize the principles of this invention without departing from the broader spirit and scope of the invention as set forth in the appended claims. All are considered within the sphere, spirit, and scope of the invention. The specification and drawings are, therefore, to be regarded in an illustrative rather than restrictive sense. Accordingly, it is not intended that the invention be limited except as may be necessary in view of the appended claims.

What is claimed is:

1. An ashtray for receiving and retaining an elongated burning-smoking-article as it burns down, the ashtray comprising:

a) a body having a perimeter wall with an outer surface, an inner surface, and a bottom;

b) said body having at least one ashtray receptacle defined therein for receiving and retaining the burned remains of the burning-smoking-article;

c) a smoking-article-holding structure having a top surface and at least one side wall, said smoking-article-holding structure cooperating with the perimeter wall to define said at least one ashtray receptacle;

d) at least four smoking-article-holding grooves formed in the top surface of the smoking-article-holding structure in generally parallel relationship, said grooves adapted to receive and retain the burning-smoking-article in a substantially horizontal position in order to maintain a radially-even burn on the burning-smoking-article, said grooves each having a different longitudinal length in order to support and balance a substantial portion of the continuously-decreasing longitudinal length of the burning-smoking-article, so as to provide support for the burning-smoking article as it burns down.

2. An ashtray for receiving and retaining an elongated burning-smoking-article as it burns down, the ashtray comprising:

a) a body having a perimeter wall with an outer surface, an inner surface, a top surface, and a bottom;

b) said body having at least one ashtray receptacle defined therein for receiving and retaining the burned remains of the burning-smoking-article;

c) at least four smoking-article-holding grooves formed in the top surface of the perimeter wall, said grooves extending from the outer surface to the inner surface, said grooves adapted to receive and retain the burning-smoking-article in a substantially horizontal position in order to maintain a radially-even burn on the burning-smoking-article, said grooves each having a different longitudinal length in order to support and balance a substantial portion of the continuously-decreasing longitudinal length of the burning-smoking-article, so as to provide support for the burning-smoking article as it burns down.

3. The ashtray of claim 1 or 2 wherein said at least four smoking-article-holding grooves comprise:

a) a first groove which supports and balances a substantial portion of the unburned longitudinal length of the burning-smoking-article when about sixty to ninety-five percent of the longitudinal length of the burning-smoking-article remains unburned;

b) a second groove which supports and balances a substantial portion of the unburned longitudinal length of the burning-smoking-article when about fifty to ninety percent of the longitudinal length of the burning-smoking-article remains unburned;

c) a third groove which supports and balances a substantial portion of the unburned longitudinal length of the burning-smoking-article when about forty to eighty-five percent of the longitudinal length of the burning-smoking-article remains unburned; and d) a fourth groove which supports and balances a substantial portion of the unburned longitudinal length of the burning-smoking-article when about thirty to eighty percent of the longitudinal length of the burning-smoking-article remains unburned.

4. The ashtray of claim 1 or 2 wherein said at least four smoking-article-holding grooves comprise: a first groove; a second groove that has a longitudinal length which is at least five percent less than the longitudinal length of the first groove; a third groove that has a longitudinal length which is at least five percent less than the longitudinal length of the second groove; and a fourth groove that has a longitudinal length which is at least five percent less than the longitudinal length of the third groove.

5. The ashtray of claim 1 or 2 wherein the elongated burning-smoking-article is about four to nine inches in length.

* * * * *